US007861551B2

(12) United States Patent
Hortin

(10) Patent No.: US 7,861,551 B2
(45) Date of Patent: Jan. 4, 2011

(54) METHOD AND DEVICE FOR PRODUCING ICE DROPLETS ON DEMAND

(75) Inventor: Gregory Gene Hortin, Henderson, KY (US)

(73) Assignee: Whirlpool Corporation, Benton Harbor, MI (US)

( * ) Notice: Subject to any disclaimer, the term of this patent is extended or adjusted under 35 U.S.C. 154(b) by 150 days.

(21) Appl. No.: 11/948,527

(22) Filed: Nov. 30, 2007

(65) Prior Publication Data

US 2009/0139258 A1 Jun. 4, 2009

(51) Int. Cl.
*F25D 3/00* (2006.01)
*F25C 1/00* (2006.01)

(52) U.S. Cl. ..... 62/389; 62/347; 62/74

(58) Field of Classification Search ..... 62/3.6–3.7, 62/66, 340, 389, 74, 347, 379, 398; 222/416.6, 222/144.5

See application file for complete search history.

(56) References Cited

U.S. PATENT DOCUMENTS

| | | | | |
|---|---|---|---|---|
| 3,024,117 | A * | 3/1962 | Barlow | 426/474 |
| 4,402,193 | A | 9/1983 | McFee | |
| 4,498,607 | A * | 2/1985 | Jaschinski | 222/146.6 |
| 4,748,817 | A * | 6/1988 | Oura et al. | 62/74 |
| 5,219,383 | A | 6/1993 | Minari et al. | |
| 5,292,030 | A | 3/1994 | Kateman et al. | |
| 5,758,571 | A | 6/1998 | Kateman et al. | |
| 6,038,869 | A | 3/2000 | Lee et al. | |
| 6,158,228 | A | 12/2000 | Nakamura et al. | |
| 6,223,542 | B1 | 5/2001 | Jones et al. | |
| 6,494,049 | B1 | 12/2002 | Jones et al. | |
| 6,555,154 | B2 | 4/2003 | Jones et al. | |
| 6,915,643 | B2 | 7/2005 | Fukumoto et al. | |
| 6,931,874 | B2 | 8/2005 | Dawe et al. | |
| 2004/0237567 | A1 | 12/2004 | Nagasawa et al. | |
| 2005/0056032 | A1 * | 3/2005 | Kim et al. | 62/126 |
| 2005/0268639 | A1 * | 12/2005 | Hortin et al. | 62/389 |
| 2006/0196214 | A1 * | 9/2006 | Lee et al. | 62/344 |
| 2007/0163286 | A1 * | 7/2007 | Lim et al. | 62/389 |

FOREIGN PATENT DOCUMENTS

| | | |
|---|---|---|
| JP | 6281303 | 10/1994 |
| JP | 6281307 | 10/1994 |

* cited by examiner

*Primary Examiner*—Frantz F Jules
*Assistant Examiner*—Cassey Bauer
(74) *Attorney, Agent, or Firm*—Kirk W. Goodwin; John W. Morrison; Diederiks & Whitelaw PLC

(57) ABSTRACT

A method and device for producing ice droplets on-demand in a refrigerator is provided wherein small water droplets are dropped from a valve through a supercooled chamber where the water freezes and forms ice pieces, such as in the form of pellets, while free-falling through the chamber, with the ice being directed to a dispenser assembly. The size and dispensing rate of the droplets can be selected by a user and regulated by a controller. The method and device eliminates the need for bulk ice storage and dispensing components.

20 Claims, 3 Drawing Sheets

METHOD AND DEVICE FOR PRODUCING ICE DROPLETS ON DEMAND

BACKGROUND OF THE INVENTION

1. Field of the Invention

The present invention pertains to the art of refrigerators and, more particularly, to a method and device for producing ice droplets on demand in a refrigerator ice/water dispenser.

2. Description of the Related Art

Door mounted ice/water dispensing systems are widely known in the art of refrigerators. Depending upon a particular refrigerator model, the dispensing systems are available with a variety of options. For example, top mount and bottom mount refrigerators typically only include a water dispensing option, while side-by-side models often include both water and ice dispensing options. The dispensing system will generally include a switch that is activated by a glass or other beverage holder to initiate dispensing of either water or ice. Ice dispensing may also include options for dispensing crushed and/or cubed ice.

Traditionally, ice dispensing systems manufacture ice cubes in a cubed shape. In an attempt to divert from the traditional shape, some ice dispensing systems are able to dispense ice shaped in the form of a disk or a ball. However, these ice dispensing systems require an ice mold and a container to hold ice in order to provide ice on-demand.

Furthermore, prior ice dispensing systems have attempted to dispense ice in different sizes. These attempts have included shavers, crushers and choppers that break the ice cube, disk or ball into smaller pieces. However, like an ice mold and an ice container used in prior ice dispensing systems, the choppers and shavers take up space in a refrigerator, eliminating valuable storage area.

Based on the above, there exists a need for a water and ice dispensing system in a refrigerator that is compact, accommodates ice and water on-demand and provides more storage space.

SUMMARY OF THE INVENTION

The present invention is directed to an ice/water dispensing system including a dispenser assembly, a control system and a supercooled chamber. The control system preferably includes a controller, a valve and a nozzle. The controller controls the valve and the nozzle. The valve enables water to flow from the valve to the nozzle, while the controller controls the amount of water that flows through the valve. The water inputted into the nozzle from the valve is outputted through multiple orifices in the nozzle. The orifices are preferably of the type that can open and close to vary the size of each orifice, such as a rotating orifice. Furthermore, the multiple orifices enable multiple water droplets to be dispersed at one time. The water droplets from the orifices are then dispersed in the direction of the supercooled chamber.

In accordance with the invention, the supercooled chamber is configured to transform free-falling water into ice as the ice/water continues falling. The supercooled chamber is provided with a passageway therethrough for water to enter at a first end of the passageway. When the supercooled chamber is not activated, water flows from the first end of the passageway to a second end and into the dispenser assembly. When the supercooled chamber is activated, the water entering at the first end turns to ice as the water/ice falls to the second end of the passageway and out of the supercooled chamber to the dispenser assembly.

The dispenser assembly is mounted on a refrigerator door and enables a user to fill a container with ice and/or water. Preferably, the dispenser assembly includes multiple actuation switches, e.g. a water select button, an ice select button, ice size varying buttons and an ice rate dispensing control.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF A PREFERRED EMBODIMENT

Figure 1:
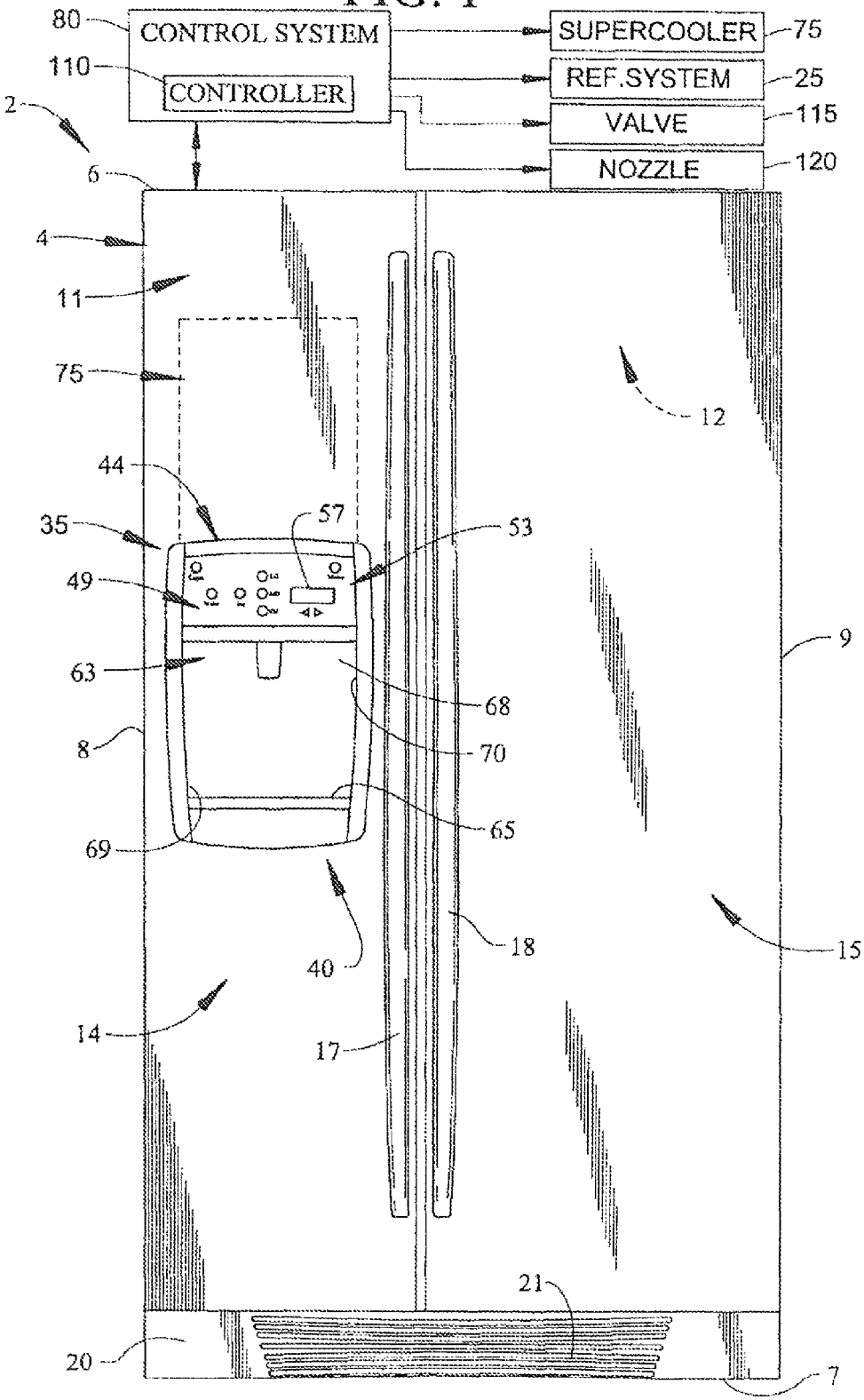
FIG. 1 is a front plan view of a side-by-side refrigerator incorporating a water/ice dispenser including a dispenser assembly and dispenser control system constructed in accordance with the present invention.

With initial reference to FIG. 1, a refrigerator constructed in accordance with the present invention is generally indicated at 2. Refrigerator 2 includes a cabinet 4 having a top wall 6, a bottom wall 7 and opposing side walls 8 and 9. In a manner known in the art, refrigerator 2 includes a freezer compartment 11 and a fresh food compartment 12. Freezer compartment 11 includes a corresponding freezer compartment door 14 and fresh food compartment 12 includes a corresponding fresh food compartment door 15. In a manner also known in the art, each door 14, 15 includes an associated handle 17, 18. Refrigerator 2 is also shown to include a kick plate 20 arranged at a bottom portion thereof having a vent 21 that permits air to flow about refrigeration components (not shown) of a refrigeration system 25 used to establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models.

In accordance with the invention, refrigerator 2 includes an ice/water dispensing system 35 which includes a dispenser assembly 40, a supercooled or supercooling chamber 75 and a dispenser control system 80. Dispenser assembly 40 has a main housing 44 and an interface 49. Interface 49 includes a plurality of control buttons 53 which enable a user to select a preferred dispensing operation. Interface 49 further includes a display 57 which enables the user to select particular operational parameters for refrigerator 2 as discussed further below.

Dispenser assembly 40 includes a dispenser well 63 having a base or container support portion 65, a recessed, upstanding wall section 68 and a pair of opposing side walls 69 and 70. An outlet (not shown) is arranged in an upper portion (not separately labeled) of dispenser well 63 and aimed to deliver a flow of water or ice downward into a container placed in dispenser well 63.

Placed above main housing 44 is supercooled chamber 75. Hereinafter a supercooled chamber is defined as a chamber which produces a temperature preferably in the range of −20°

F. to −30° F. (approximately −29° C. to −34° C.). Control system 80 activates supercooled chamber to produce the the range of −20° F. to −30° F. (approximately −29° C. to −34° C.). Supercooled chamber 75 constitutes a quick freeze unit and can employ various chilling circuits known in the art. For instance, a preferred embodiment utilizes a thermoelectric unit, but the cooling capacity could be achieved in other ways such as through refrigeration circuit 25.

Figure 2:
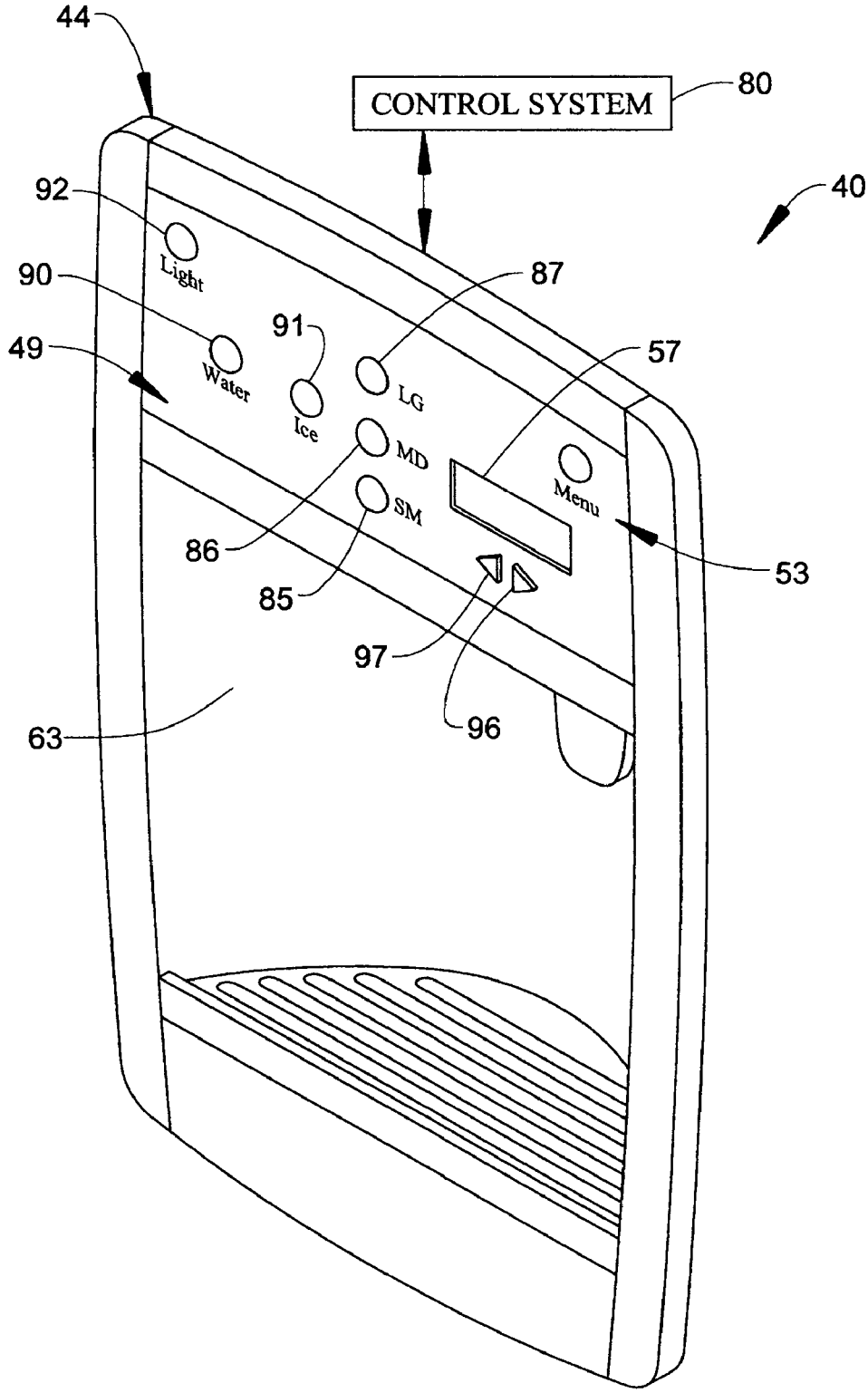
FIG. 2 is an enlarged perspective view of the dispenser assembly of FIG. 1.

FIG. 2 shows a more detailed view of dispenser assembly 40 including main housing 44. The plurality of control buttons 53 on interface 49 include control buttons 85, 86 and 87 enabling a user to select a size of a water droplet dispensed from control system 80. Furthermore, the plurality of control buttons 53 includes a water select button 90 and an ice select button 91. Lastly, the plurality of control buttons 53 includes a light button 92 to turn on a light (not shown) and illuminate dispensing well 63. A pair of arrow buttons 96 and 97 on interface 49 is used to select a desired dispensing rate of water/ice as discussed further below. As can been seen in FIG. 2, interface 49 is in communication with control system 80. When a button on interface 49 is selected, interface 49 produces a signal indicating which button was pressed and inputs that signal to control system 80.

Figure 3:
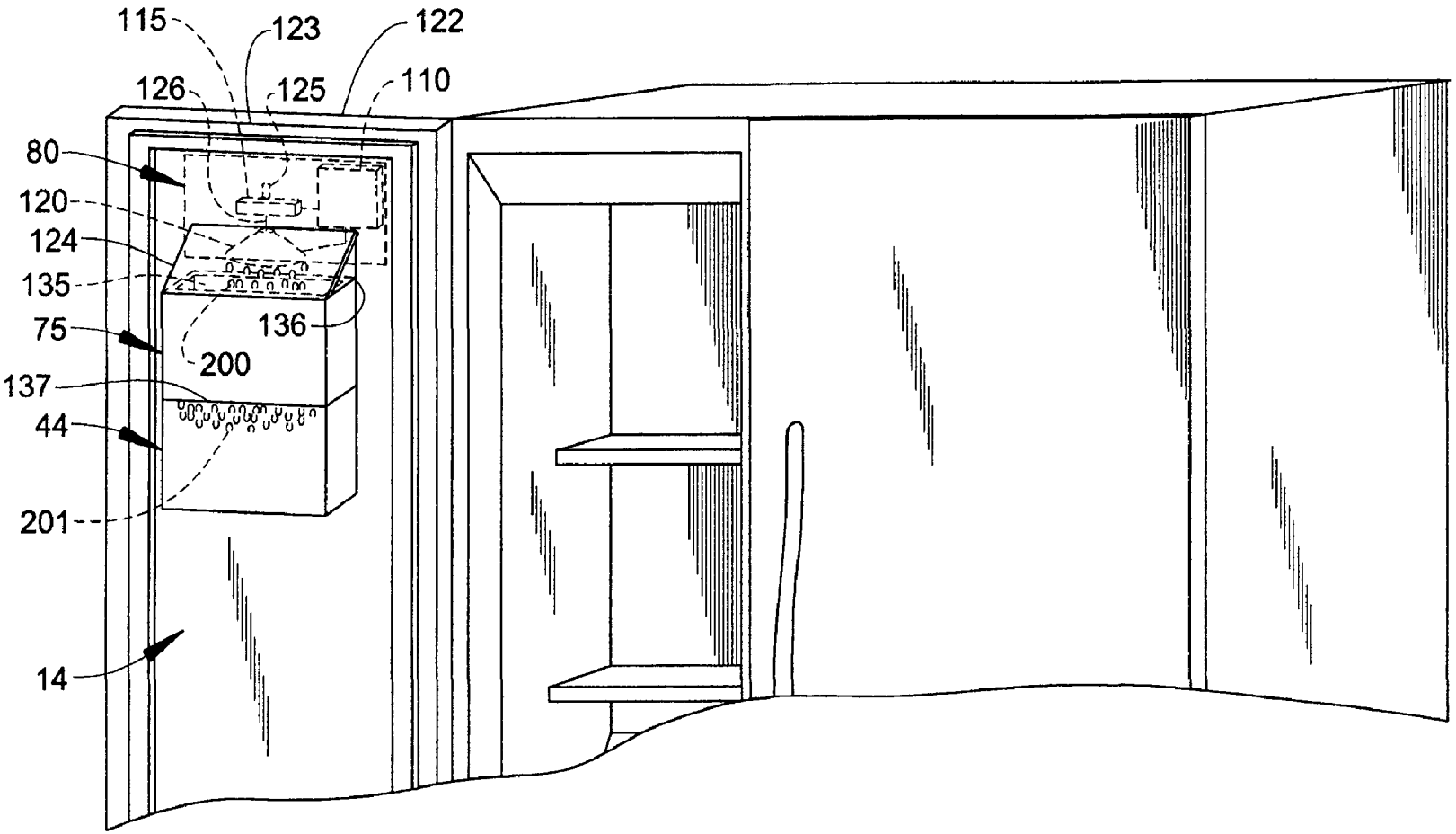
FIG. 3 is a perspective view of the dispenser control system and associated supercooled chamber employed in the invention.

Supercooled chamber 75 is shown in conjunction with main housing assembly 44 in FIG. 3. Control system 80 includes a controller 110, a valve 115 and a water inlet in the form of a nozzle 120. Controller 110 and valve 115 are preferably mounted between a front side 122 of freezer door 14 and a rear side 123 of freezer door 14. On the other hand, as controller 110 is only electronically linked to valve 115, nozzle 120 and interface 49, controller 110 could be easily mounted in another location. In any case, controller 110 and valve 115 are preferably not exposed. As shown, valve 120, which preferably constitutes a four-position solenoid valve enabling a small flow, medium flow, high flow or no flow therethrough, is protected from freezer compartment 11 with a cover 124.

Controller 110 receives inputs from interface 49 of main housing 44 and outputs control signals to valve 115 and nozzle 120 based on the inputs received from interface 49. Valve 115 receives water from a water inlet 125, controls water flow based on a signal from controller 110 and dispenses water to nozzle 120 via a valve outlet 126. Nozzle 120 has a plurality of orifices wherein water is dispersed, in the form of droplets, therefrom and into supercooled chamber 75. The orifices are preferably adjustable, such as the rotating type, allowing a droplet size to be readily varied. Controller 110 controls an opening size of each respective orifice based on an input received from interface 49. More specifically, as referenced above, the user can select a desired size for ice pieces through buttons 85-87, with this selection actually signaling controller 110 to set requisite orifice sizes for nozzle 120.

With further reference to FIG. 3, supercooled chamber 75 has a passageway 135 extending therethrough, from a first end 136 to a second end 137 of supercooled chamber 75. As stated above, supercooled chamber 75 produces a temperature preferably in the range of −20° F. to −30° F. when activated, thereby enabling free-falling water entering first end 136 to be transformed into ice droplets by second end 137. During use, controller 110 outputs a chamber activation signal to supercooled chamber 75 when a user presses ice button 91. Therefore, when supercooled chamber 75 is activated, water 200 is dispensed from nozzle 120 into first end 136 of passageway 135. Ice 201 is then outputted from second end 137, into dispenser main housing 44 and then to a user's container (not shown) placed in dispenser well 63.

Dispenser assembly 40, supercooled chamber 75, and control system 80 provide for a convenient and efficient way to dispense ice or water on-demand. When a user wishes to fill a container with ice and/or water, the user inserts the container into dispensing well 63. If the user selects water to be dispensed, the water can flow either through nozzle 120, without activation of supercooled chamber 75, or a separate water flow tube (not shown). More specifically, if the user presses water button 90, then controller 110 does not activate supercooled chamber and water flows through passageway without being transformed into ice and, therefore, water is dispensed into a user's container. However, if ice button 91 is selected, controller 110 activates supercooled chamber 75 and free-falling water from nozzle 120 transforms into ice as it passes through passageway 135. The ice is then dispensed into a user's container at dispensing well 63 of dispenser main housing 44. When ice dispensing is selected, the user can further alter a desired droplet size from buttons 85, 86 and 87 and/or select a desired dispensing rate from arrows 96 and 97. In any case, the user will select whether ice or water is desired by pressing either button 90 or button 91. Interface 49 sends an input to controller 110 of control system 80 for each respective button that was pressed. Controller 110 then controls valve 115 and nozzle 120 based on the inputs from interface 49.

Based on the above, it should be readily apparent that the present invention advantageously provides for ice, in varying selective sizes, to be delivered on demand, while simultaneously avoiding the need to store preformed ice. Although described with reference to preferred embodiments of the invention, it should be readily understood that various changes and/or modifications can be made to the invention without departing from the spirit thereof. In general, the invention is only intended to be limited by the scope of the following claims.

What is claimed is:

1. A refrigerator comprising:

a cabinet within which is defined a freezer compartment;

a door pivotally mounted to the cabinet for selectively accessing the freezer compartment; and an ice and water dispensing system including:

a water inlet exposed to the freezer compartment;

a dispenser assembly including an interface that allows user selections for dispensing ice and water;

a supercooling chamber arranged in the freezer compartment and defining a passageway, having an upper inlet and a lower outlet, extending through the chamber; and a control system for both establishing a supercooled environment in the chamber and regulating a delivery of water from the water inlet;

wherein, when a supercooled environment having a temperature lower than a temperature of said freezer compartment is established in the chamber and water is delivered from the water inlet into the upper inlet of the passageway, the water freezes while traveling through the chamber in order to establish ice which is directed to the dispenser assembly.

2. The refrigerator according to claim 1, wherein the interface of the dispenser assembly allows a user to select an ice dispensing rate from a plurality of ice dispensing rates including at least slow and fast dispensing rates.

3. The refrigerator according to claim 1, wherein the interface of the dispenser assembly allows the selection of a water droplet size.

4. The refrigerator according to claim 1, wherein the control system includes a controller, a water flow valve and a nozzle.

5. The refrigerator according to claim 4, wherein the controller controls each of the valve, to regulate a flow rate of water, and the nozzle, to regulate a size of dispensed water droplets.

6. The refrigerator according to claim 4, wherein the interface enables a user to set desired dispensing parameters, wherein the interface is linked to the controller.

7. The refrigerator according to claim 6, wherein one of the desired dispensing parameters is a dispensing rate of ice which is selected from a plurality of dispensing rates including at least slow and fast dispensing rates.

8. The refrigerator according to claim 6, wherein one of the desired dispensing parameters is a size of ice pieces delivered to the dispensing assembly.

9. The refrigerator according to claim 5, wherein the nozzle includes a plurality of adjustable orifices to regulate a size of dispensed water droplets.

10. A refrigeration unit including a freezer compartment and a combination ice and water dispensing system comprising:

a water inlet;

a dispenser assembly having an interface that allows user selections for dispensing ice and water;

a supercooling chamber defining a passageway, having an upper inlet portion and a lower outlet portion, extending through the chamber, said water inlet being exposed at the upper inlet portion; and a control system for both establishing a supercooled environment having a temperature lower than a temperature of said freezer compartment in the chamber and regulating a delivery of water from the water inlet wherein, when a supercooled environment is established in the chamber and water is delivered from the water inlet into the upper inlet of the passageway, the water freezes upon traveling through the chamber in order to establish ice which is directed to the dispenser assembly.

11. The refrigeration unit according to claim 10, wherein the interface allows a user to select an ice dispensing rate from a plurality of ice dispensing rates including at least slow and fast dispensing rates.

12. A refrigeration unit including a freezer compartment and a combination ice and water dispensing system comprising:

a water inlet;

a dispenser including a well exposed at a front portion of the refrigeration unit;

a supercooling chamber defining a passageway, having an upper inlet portion and a lower outlet portion, extending through the chamber, said water inlet being exposed at the upper inlet portion; and a control system, including a controller, a valve and a nozzle having at least one orifice, for both establishing a supercooled environment having a temperature lower than a temperature of said freezer compartment in the chamber and regulating a delivery of water from the water inlet wherein, when a supercooled environment is established in the chamber and water is delivered from the water inlet into the upper inlet of the passageway, the water freezes upon traveling through the chamber in order to establish ice which is directed to the dispenser.

13. The refrigeration unit according to claim 12, wherein the controller controls each of the valve, to regulate a flow rate of water, and the nozzle, to regulate a size of dispensed water droplets.

14. The refrigeration unit according to claim 12, further comprising: an interface for enabling a user to set desired dispensing parameters, wherein the interface is linked to the controller and one of the desired dispensing parameters is a dispensing rate of water which is selected from a plurality of dispensing rates including at least slow and fast dispensing rates.

15. The refrigeration unit according to claim 12, further comprising: an interface for enabling a user to set desired dispensing parameters, wherein the interface is linked to the controller and one of the desired dispensing parameters is a size of ice pieces delivered to the dispensing system.

16. The refrigeration unit according to claim 13, wherein the nozzle includes a plurality of adjustable orifices to regulate a size of dispensed water droplets.

17. A method of controlling the formation and dispensing of ice in a refrigerator having a cabinet containing a refrigeration compartment and a freezer compartment, a door for selectively closing one of the refrigeration compartment and the freezer compartment, and a dispenser assembly, including a dispenser interface mounted to the door, for selectively dispensing ice, the method comprising:

selecting, through a dispenser interface, an ice dispensing operation;

selecting a desired ice dispensing rate through the dispenser interface from a plurality of dispensing rates including at least slow and fast dispensing rates;

activating a supercooled chamber such that the supercooled chamber reaches a temperature lower than a temperature of said freezer compartment;

controlling at least one of a valve and a nozzle based on the desired dispensing rate;

delivering water into the supercooled chamber;

changing the water to ice while passing through the supercooled chamber; and directing the ice to the dispenser assembly.

18. The method of claim 17, wherein the step of controlling constitutes controlling the nozzle by adjusting sizes of a plurality of orifices in said nozzle.

19. A method of controlling the formation and dispensing of ice in a refrigerator having a cabinet containing a refrigeration compartment and a freezer compartment, a door for selectively closing one of the refrigeration compartment and the freezer compartment, and a dispenser assembly, including a dispenser interface mounted to the door, for selectively dispensing ice, the method comprising:

selecting, through a dispenser interface, an ice dispensing operation;

selecting a desired size for the ice through the dispenser interface;

activating a supercooled chamber such that the supercooled chamber reaches a temperature lower than a temperature of said freezer compartment;

controlling at least one of a valve and a nozzle based on the desired size;

delivering water into the supercooled chamber;

changing the water to ice while passing through the supercooled chamber; and directing the ice to the dispenser assembly.

20. The method of claim 19, further comprising: selecting a desired ice dispensing rate through the dispenser interface from a plurality of dispensing rates including at least slow and fast dispensing rates.

* * * * *